US009385471B2

(12) United States Patent
Zhu et al.

(10) Patent No.: US 9,385,471 B2
(45) Date of Patent: Jul. 5, 2016

(54) MAGNETIC CONNECTOR ASSEMBLY

(71) Applicant: FOXCONN INTERCONNECT TECHNOLOGY LIMITED, Grand Cayman (KY)

(72) Inventors: Jian-Jun Zhu, Kunshan (CN); Qing-Man Zhu, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/710,911

(22) Filed: May 13, 2015

(65) Prior Publication Data

US 2015/0333440 A1 Nov. 19, 2015

(30) Foreign Application Priority Data

May 13, 2014 (CN) ..... 2014 1 0199260

(51) Int. Cl.
*H01R 11/30* (2006.01)
*H01R 13/62* (2006.01)

(52) U.S. Cl.
CPC ..... *H01R 13/6205* (2013.01)

(58) Field of Classification Search
CPC . H01R 13/6205; H01R 13/44; H01R 13/7037
USPC ..... 439/39
See application file for complete search history.

(56) References Cited

U.S. PATENT DOCUMENTS

| | | | | |
|---|---|---|---|---|
| 5,829,987 | A * | 11/1998 | Fritsch | H01R 13/7037 200/51.09 |
| 6,340,320 | B1 | 1/2002 | Ogawa | |
| 7,311,526 | B2 | 12/2007 | Rohrbach et al. | |
| 7,329,151 | B2 | 2/2008 | Wu | |
| 7,341,458 | B1 | 3/2008 | Koh | |
| 7,625,213 | B1 * | 12/2009 | Tse | H01R 13/6205 439/22 |
| 7,632,134 | B2 | 12/2009 | Su et al. | |
| 8,535,088 | B2 | 9/2013 | Gao et al. | |
| 8,770,986 | B2 * | 7/2014 | Furness | H01R 13/6205 439/39 |
| 2006/0051981 | A1 * | 3/2006 | Neidlein | H01R 13/6205 439/39 |
| 2007/0072443 | A1 * | 3/2007 | Rohrbach | H01R 13/6205 439/39 |
| 2008/0003841 | A1 * | 1/2008 | Su | H01R 13/44 439/55 |
| 2008/0280495 | A1 * | 11/2008 | Ko | H01R 43/0256 439/638 |
| 2013/0210244 | A1 | 8/2013 | DiFonzo et al. | |

* cited by examiner

*Primary Examiner* — Jean F Duverne
(74) *Attorney, Agent, or Firm* — Ming Chieh Chang; Wei Te Chung

(57) ABSTRACT

An electrical connector assembly includes a first connector including a first magnetic element and a number of first contacts, and a second connector including a second magnetic element and a number of second contacts. The first magnetic element and the second magnetic element include a pair of opposite poles located at two ends thereof respectively along a direction perpendicular to a mating direction of the first magnetic element and the second magnetic element. When the first connector mates with the second connector, the poles of the corresponding ends of the first magnetic and the second magnetic element are opposite.

12 Claims, 11 Drawing Sheets

MAGNETIC CONNECTOR ASSEMBLY

BACKGROUND OF THE INVENTION

1. Field of the Invention

The present invention relates to a magnetic connector assembly.

2. Description of Related Arts

U.S. Pat. No. 7,632,134, issued on Dec. 15, 2009, discloses a magnetic connector including a mating section, a magnetic element having a cavity, and a plurality of retractable, POGO-type contacts accommodated in the mating section and the cavity. The magnetic connector further includes a terminal block receiving the contacts, an internal printed circuit board, and a protective member.

U.S. Patent Application Publication No. 2013/0210244, published on Aug. 15, 2013, discloses a magnetically-conductive label and a magnetic connector system including portions of connector insert (plug) and connector receptacle. Connector receptacle may include one or more magnets, which may be covered by label. Connector insert may include an attraction plate. Magnetic field lines originating in first magnet may pass through label and attraction plate and terminate in second magnet. Specifically, magnetic field lines originating in a North pole of a magnet terminate at a South pole of another magnet. Magnets may be formed of various materials and may be arranged in various configurations. For example, a single magnet may be employed where a first magnetic element may extend from a North side of the magnet to an opening and a second magnetic element may extend from a South side of the magnet to the opening U.S. Pat. No. 7,311,526, issued on Dec. 25, 2007, discloses an electrical plug and receptacle relying on magnetic force to maintain coupling. Each of the plug and the receptacle comprises a magnetic element and a plurality of contacts accommodated in the magnetic member. Also disclosed are complementary guides that allow for only one way of coupling the plug and receptacle together to ensure proper alignment of the plug contacts with the receptacle contacts. An electrical connector assembly having guiding means is desired.

SUMMARY OF THE INVENTION

To achieve the above object, an electrical connector assembly comprises: a first connector comprising a first magnetic element having a cavity, and a plurality of first contacts accommodated in the cavity of the first magnetic element; and a second connector comprising a second magnetic element and a plurality of second contacts accommodated in the second magnetic element; wherein the first magnetic element and the second magnetic element include a pair of opposite poles located at two ends thereof respectively along a direction perpendicular to a mating direction of the first magnetic element and the second magnetic element; and wherein when the first connector mates with the second connector, the poles of the corresponding ends of the first magnetic and the second magnetic element are opposite.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
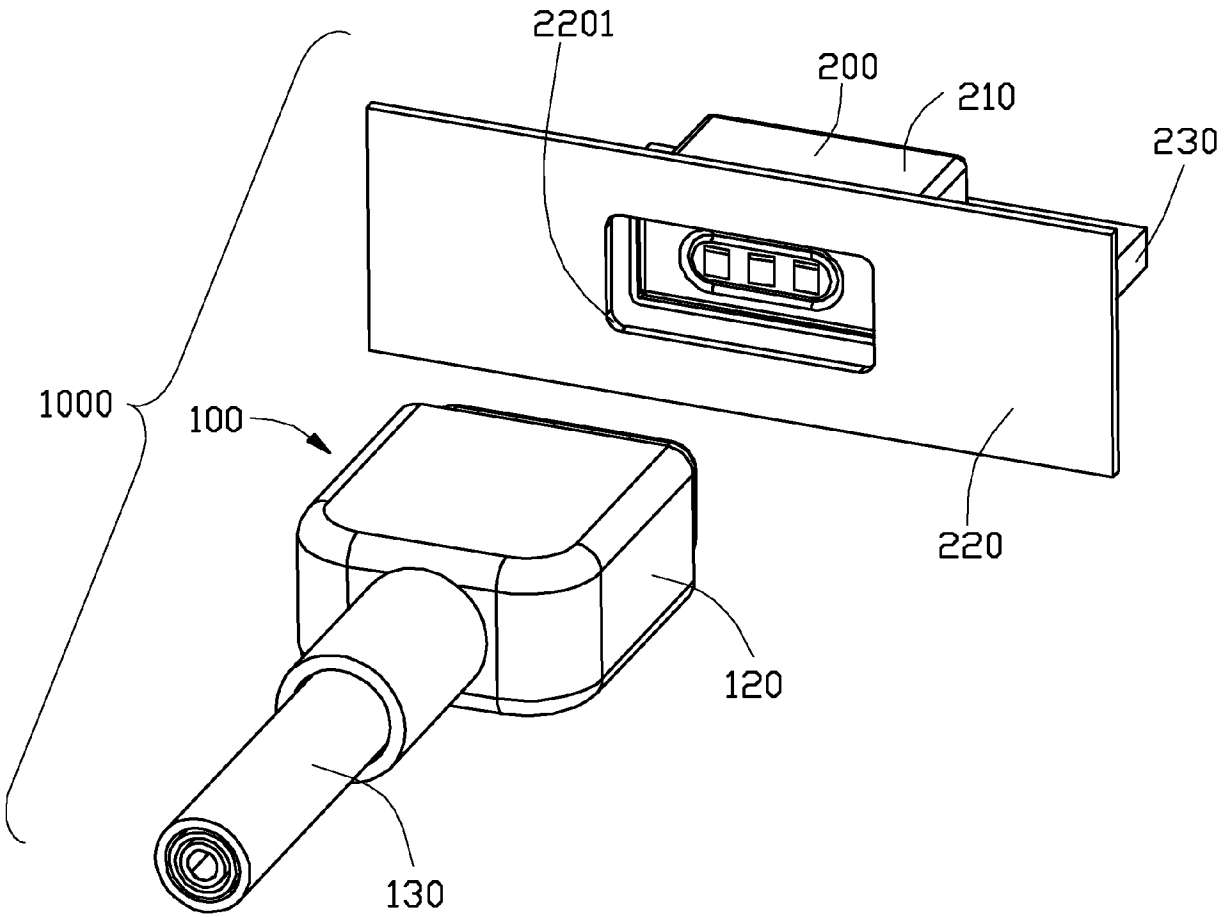
FIG. 1 is a perspective, assembled view of an electrical connector assembly when a first connector is not mated with a second connector of the present invention.
Figure 2:
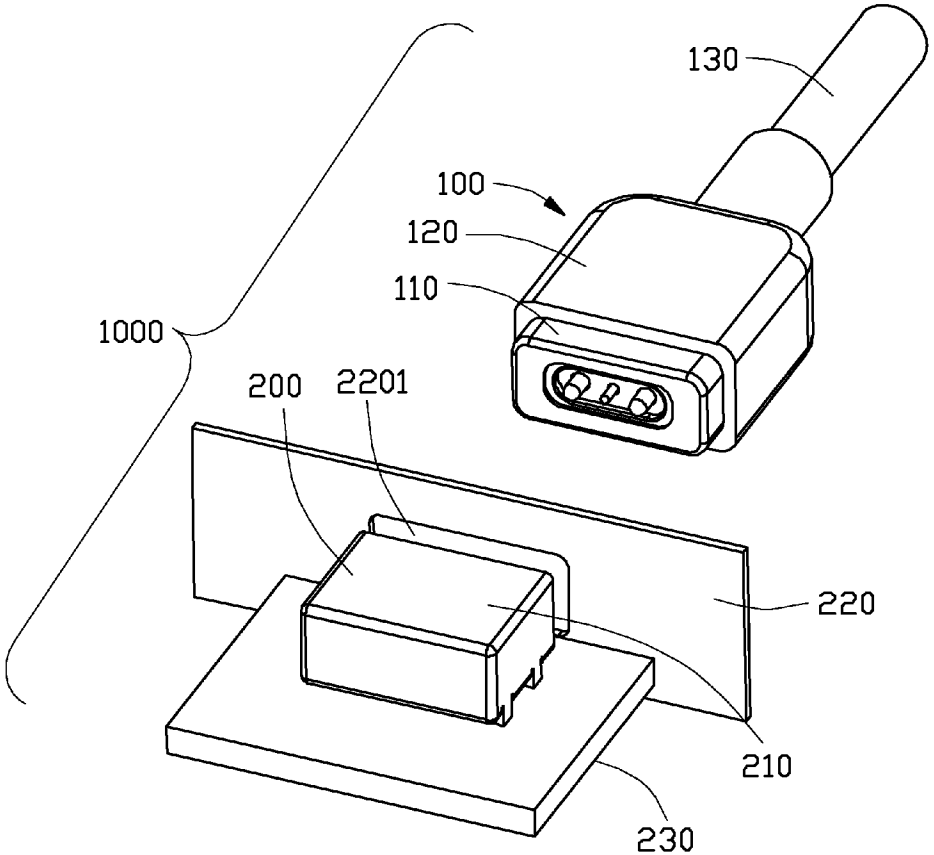
FIG. 2 is a perspective, assembled view of the electrical connector assembly, taken from a different view shown in FIG. 1.
Figure 3:
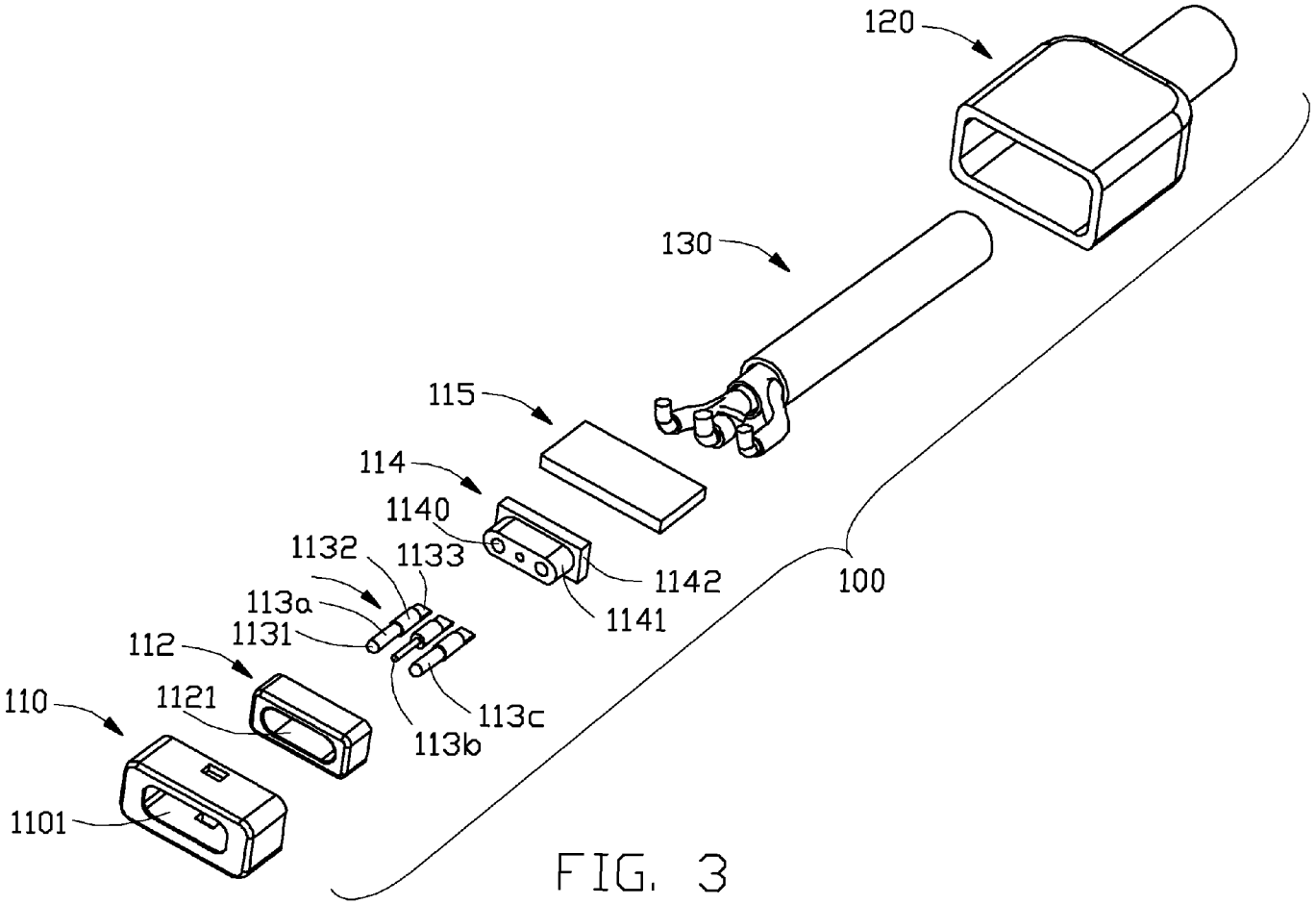
FIG. 3 is a perspective, exploded view of the first connector of the electrical connector assembly shown in FIG. 1.
Figure 4:
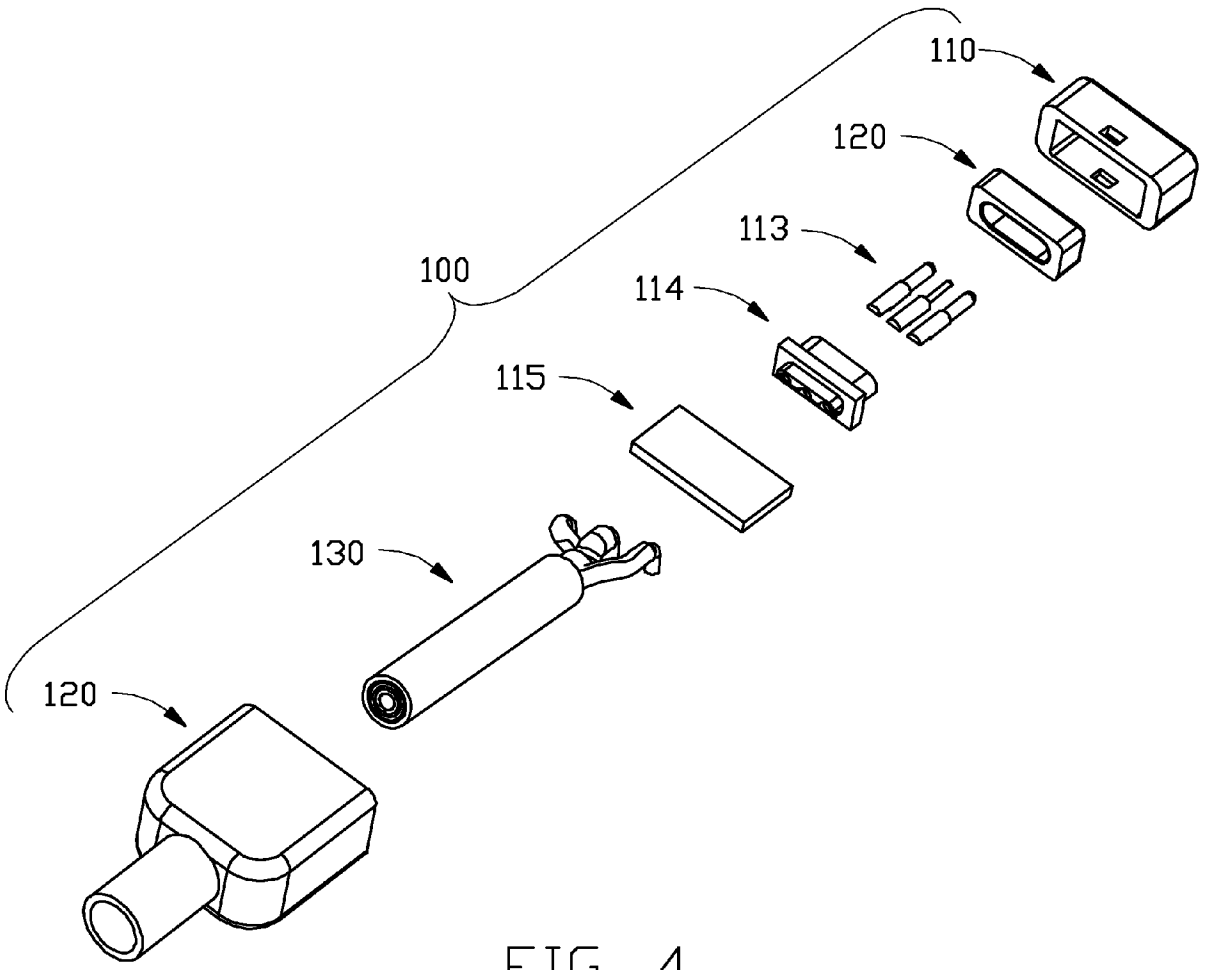
FIG. 4 is a perspective, exploded view of the first connector taken from a different view shown in FIG. 3.
Figure 5:
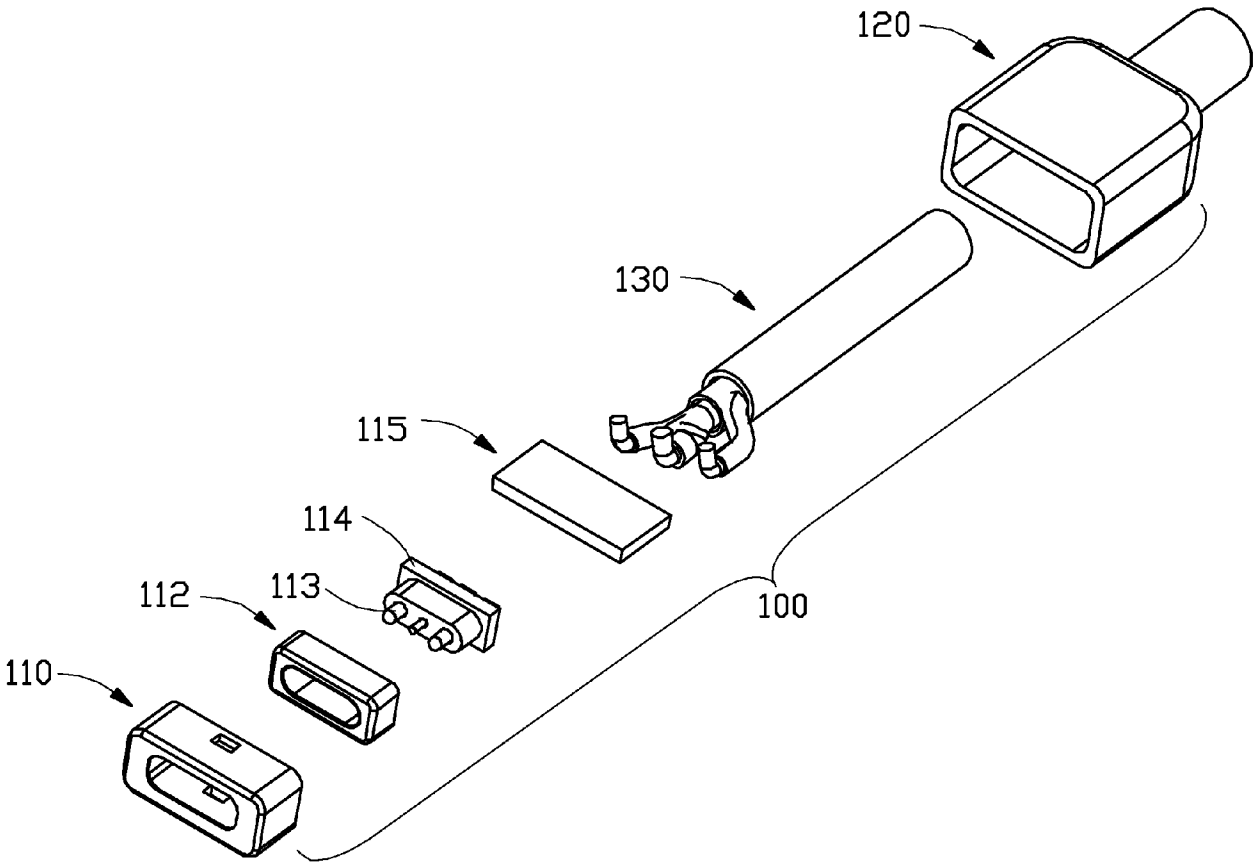
FIG. 5 is a perspective, partially assembled view of the first connector shown in FIG. 3.
Figure 6:
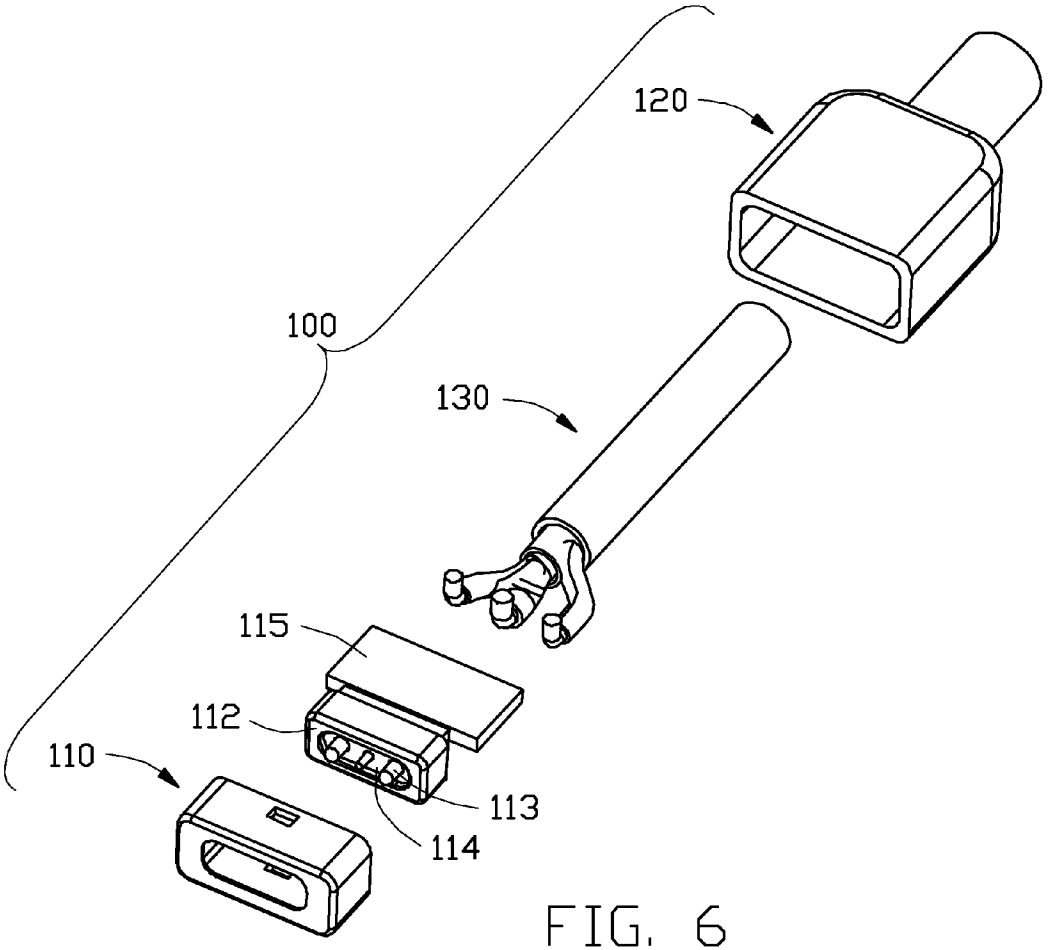
FIG. 6 is a perspective, further assembled view of the first connector shown in FIG. 5.
Figure 7:
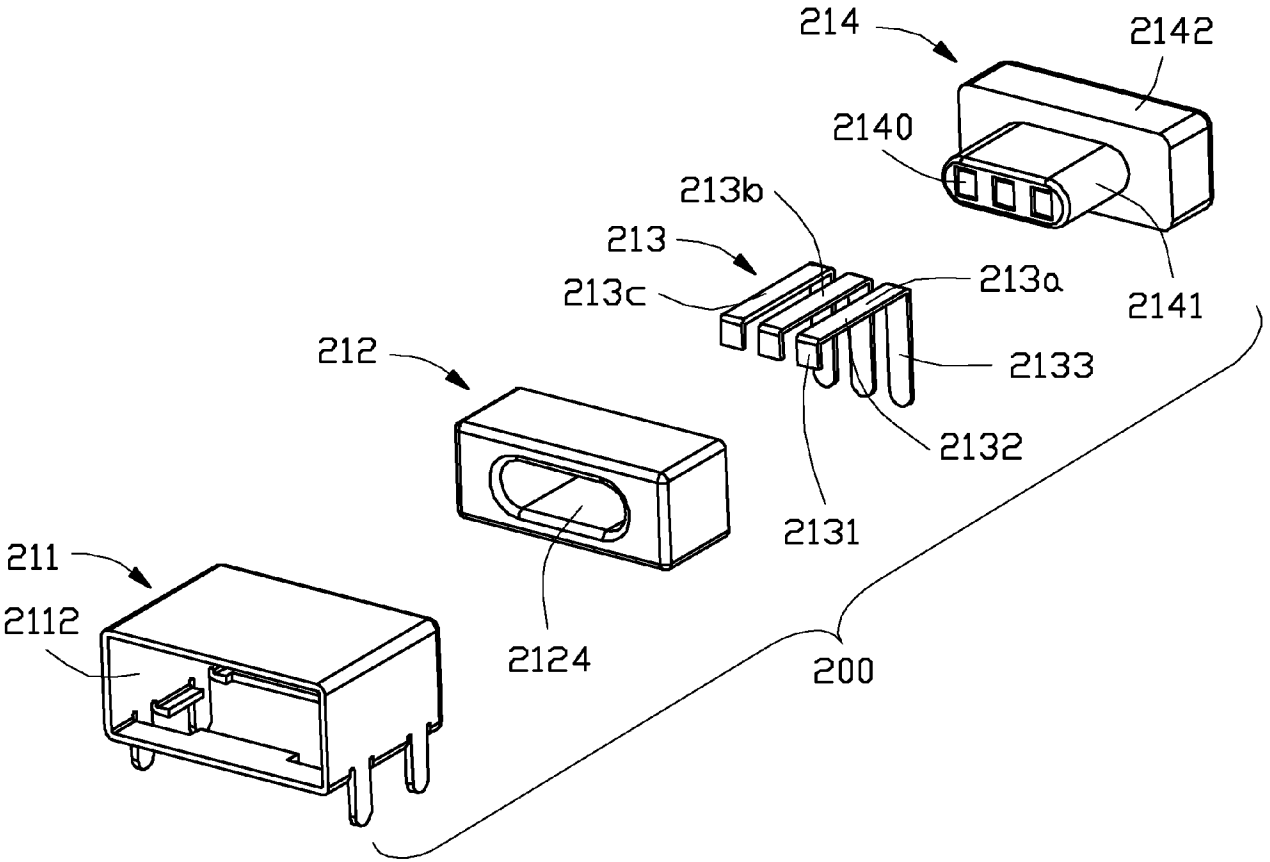
FIG. 7 is a perspective, exploded view of the second connector of the electrical connector assembly shown in FIG. 2.
Figure 8:
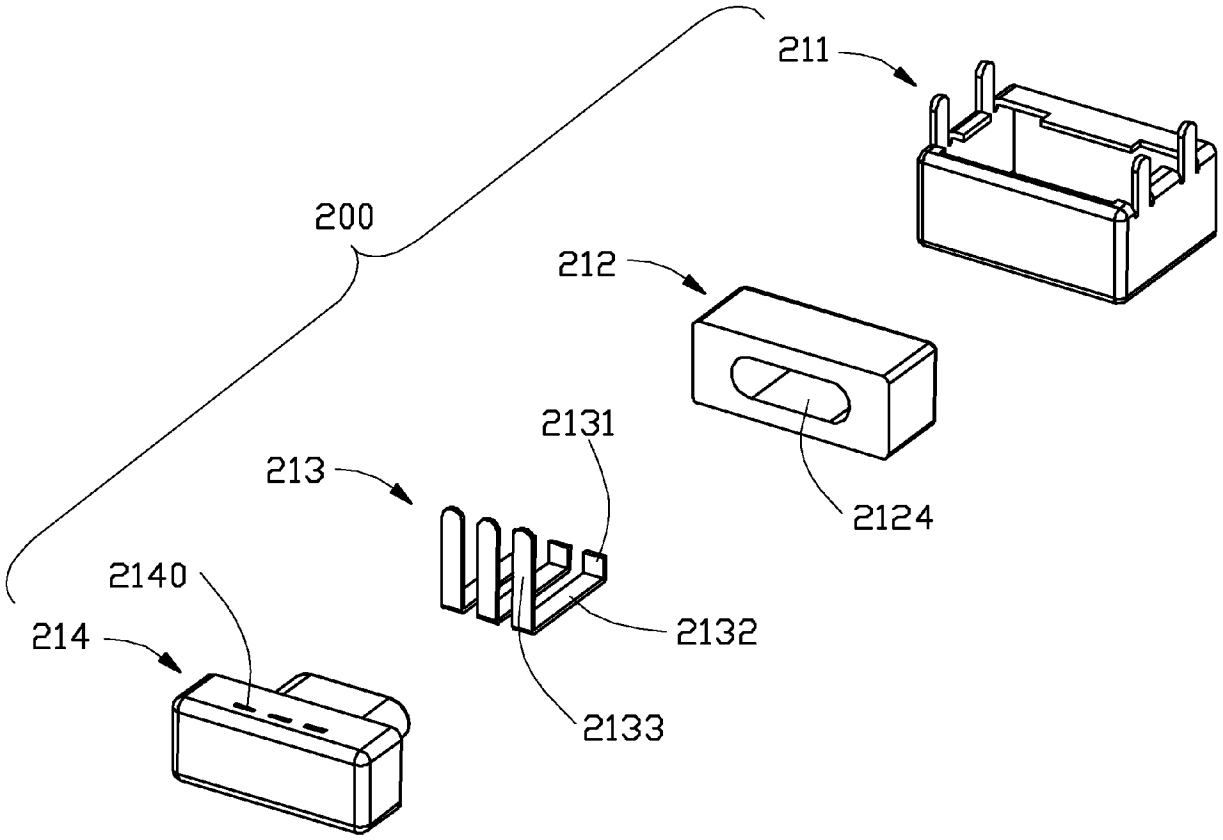
FIG. 8 is a perspective, exploded view of the second connector of the electrical connector assembly taken from a different view shown in FIG. 7.
Figure 9:
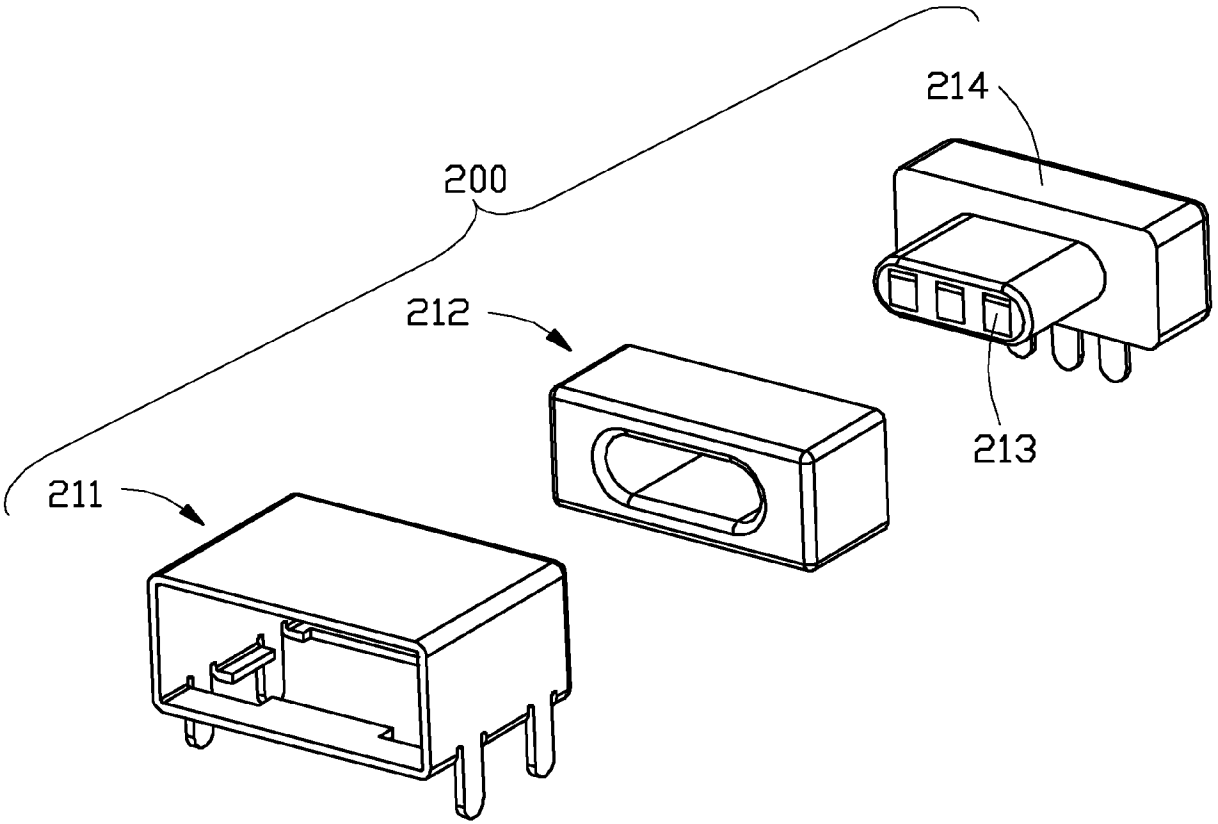
FIG. 9 is a perspective, partially assembled view of the second connector of the electrical connector assembly shown in FIG. 7.
Figure 10:
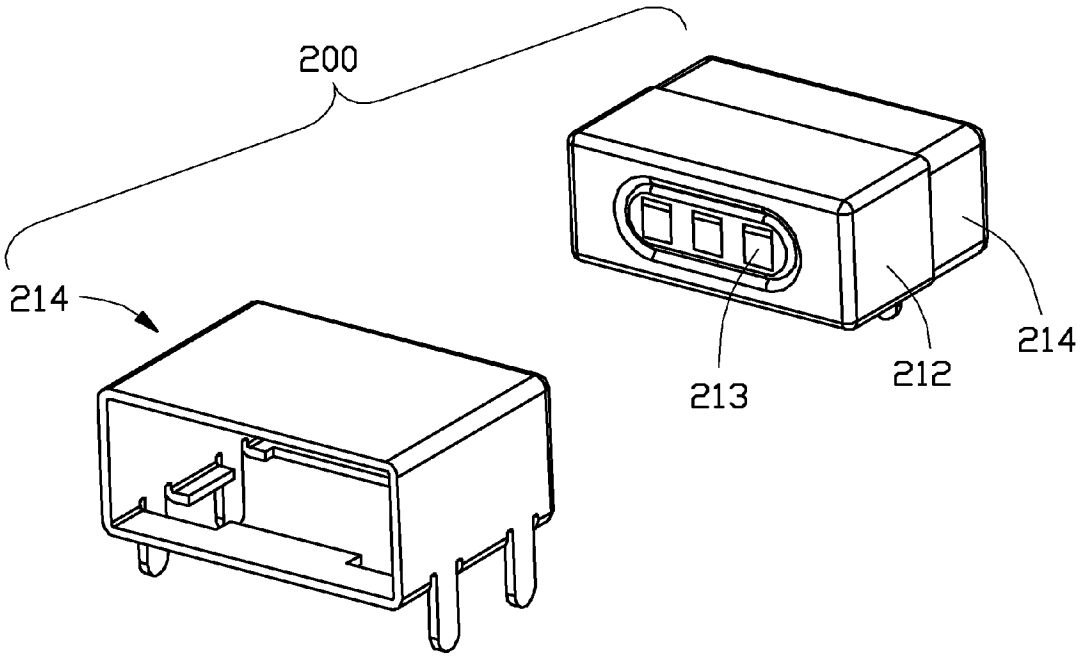
FIG. 10 is a perspective, further assembled view of the second connector of the electrical connector assembly shown in FIG. 8.

Referring to FIGS. 1 to 2, an electrical connector assembly 1000 of the present invention comprises a first connector 100, a second connector 200, a printed circuit board 230 and a panel 220 located at a front end of the second connector 200 for protecting the second connector 200. The panel 220 defines a port 2201.

Referring to FIGS. 3 to 6, the first connector 100 comprises a plurality of first contacts 113 arranged along the transverse direction, a first spacer 114 accommodating the first contacts 113, a first magnetic element 112 assembled to the first spacer 114, a first metal shell 110 assembled to the first magnetic element 112, a printed circuit board 115 connecting with the first contacts 113 electrically, a cable 130 connecting with the printed circuit board 115 and a cover 120 assembled to a rear end of the first metal shell 110 and a front end of the cable 130. The first magnetic element 112 defines a cavity 1121, and the first contacts 113 and the first spacer 114 are accommodated in the cavity 1121.

The first contacts 113 comprise a first power contact 113*a*, a first grounding contact 113*c* and a first signal contact 113*b* located between the first power contact 113*a* and the first grounding contact 113*c*. Each first contact 113 comprises a mating portion 1131 mating with the second connector 200 electrically, a holding portion 1132 extending rearwardly from the mating portion 1131 and fixing the first contact 113, and a connecting portion 1133 extending rearwardly from the holding portion 1132 and connected with the printed circuit board 115. The holding portion 1132 is thicker than the mating portion 1131 and the connecting portion 1133.

The first spacer 114 is made of plastic material, and comprises a main portion 1141 and a rear portion 1142 extending rearwardly from the main portion 1141. The rear portion 1142 is wider than the main portion 1141. The first spacer 114 defines a plurality of grooves 1140 extending through the main portion 1141 and the rear portion 1142 and receiving the first contacts 113. The mating portions 1131 of the first contacts 113 reach out of the grooves 1140.

The first magnetic element 112 surrounds the main portion 1141 and defines a receiving chamber 1121 extending through a front surface and a rear surface thereof The first metal shell 110 surrounds the first magnetic element 112 and defines a receiving space 1101 receiving the first magnetic element 112 and the first spacer 114. The periphery of the first metal shell 110 is corresponding to the port 2201 of the panel 220, so that the first metal shell 110 can enter into the port 2201 of the panel 220.

In assembly, the first contact 113 is assembled to the first spacer 114. The first magnetic element 112 is assembled to the main portion 1141 of the first spacer 114. The first contact 113 and the cable 130 are assembled to the printed circuit board 115 electrically. The first metal shell 110 is assembled to the first magnetic element 112 and the first spacer 114. The cover 120 is assembled to the rear end of the first metal shell 110 and the front end of the cable 130.

Referring to FIGS. 7 to 10, the second connector 200 comprises a plurality of second contacts 213, a second spacer 214 receiving the second contacts 213, a second magnetic element 212 assembled to the second spacer 214, a second metal shell 211 assembled to the second magnetic element 212. The second magnetic element 212 can attract the first magnetic element 112 along a single direction. The second contacts 213 are accommodated to the second magnetic element 212.

The second contacts 213 comprise a second power contact 213*a*, a second grounding contact 213*c* and a second signal contact 213*b* located between the second power contact 213*a* and the second grounding contact 213*c*. Each second contact 213 comprises a holding portion 2132, a mating portion 2131 bent forwardly from the holding portion 2132 and mating with the first connector 100, and a connecting portion 2133 bent rearwardly from the holding portion 2132 and connected with the printed circuit board 230 electrically. The mating portion 2131 and the connecting portion 2133 are perpendicular to the holding portion 2132 respectively.

The second spacer 214 is made of plastic material, and comprises a main portion 2141 and a rear portion 2142 extending rearwardly from the main portion 2141. The rear portion 2142 is wider than the main portion 2141. The second spacer 214 defines a plurality of grooves 2140 extending through the main portion 2141 and the rear portion 2142 and receiving the second contacts 213. The mating portion 2131 is located on a front surface of the second spacer 214. The second magnetic element 212 surrounds the main portion 2141 and defines a receiving chamber 2124 extending through a front surface and a rear surface thereof The second metal shell 211 surrounds the second magnetic element 212 and defines a receiving space 2112 receiving the second magnetic element 212 and the second spacer 214.

In assembly, the second contact 213 is assembled to the second spacer 214. The second magnetic element 212 is assembled to the main portion 2141 of the second spacer 214. At last, the second metal shell 211 is assembled to the second magnetic element 212 and the second spacer 214.

When the first connector 100 mates with the second connector 200, the first metal shell 110 of the first connector 100 is entered into the second connector 200 along the port 2201 of the panel 220.

Figure 11:
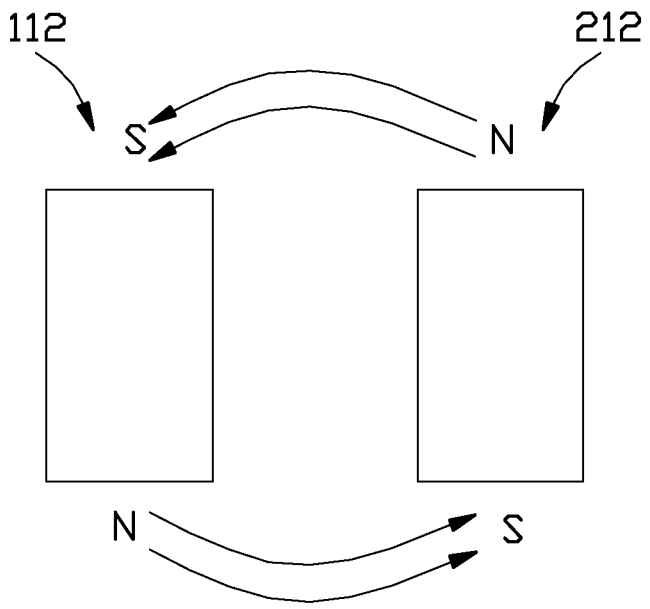
FIG. 11 is a schematic view of magnetic pole and a distribution of magnetic induction line of the electrical connector assembly shown in FIG. 2.

Referring to FIG. 11, the first magnetic element 112 includes a "N" pole and a "S" pole located at two ends thereof along a direction perpendicular to a mating direction of the first magnetic element 112 and the second magnetic element 212. The second magnetic element 212 includes a "S" pole and a "N" pole located at two sides thereof along the corresponding direction. When the first connector 100 enters into the second connector 200 in a right way, the "N" pole of the first magnetic element 112 attracts at the "S" pole of the second magnetic element 212. The poles of the corresponding ends of the first magnetic element 112 and the second magnetic element 212 are opposite and attract each other, so that the first connector 100 succeeds in mating with the second connector 200. When the first connector 100 enters into the second connector 200 in a wrong way, the poles of the corresponding ends of the first magnetic element 112 and the second magnetic element 212 are the same and reject each other, so that the first connector 100 fails to mate with the second connector 200.

What is claimed is:

1. An electrical connector assembly comprising:

a first connector comprising a first magnetic element having a cavity, and a plurality of first contacts accommodated in the cavity of the first magnetic element; and a second connector comprising a second magnetic element and a plurality of second contacts accommodated in the second magnetic element;

wherein the first magnetic element and the second magnetic element include a pair of opposite poles located at two ends thereof respectively along a direction perpendicular to a mating direction of the first magnetic element and the second magnetic element; and wherein, when the first connector mates with the second connector, the poles of the corresponding ends of the first magnetic and the second magnetic element are opposite; wherein the first contacts and the second contacts comprise a power contact, a grounding contact and a signal contact located between the power contact and the grounding contact respectively; wherein the first connector and the second connector comprise a first spacer and a second spacer accommodated therein respectively; wherein the first spacer and the second spacer comprise a main portion and a rear portion extending rearwardly from the main portion respectively; wherein the first spacer and the second spacer define a plurality of grooves extending through the main portion and the rear portion and receiving corresponding first and second contacts respectively.

2. The electrical connector assembly as claimed in claim 1, wherein each first contact comprises a mating portion mating with the second connector electrically, a holding portion extending rearwardly from the mating portion, and a connecting portion extending rearwardly from the holding portion.

3. The electrical connector assembly as claimed in claim 2, wherein the holding portion is thicker than the mating portion and the connecting portion.

4. The electrical connector assembly as claimed in claim 1, wherein each second contact comprises a holding portion, a mating portion bent forwardly from the holding portion and mating with the first connector, and a connecting portion bent rearwardly from the holding portion.

5. The electrical connector assembly as claimed in claim 1, further comprising a panel located at a front end of the second connector for protecting the second connector, the panel defining a port.

6. The electrical connector assembly as claimed in claim 5, wherein the first connector comprises a first metal shell assembled to the first magnetic element, the metal shell having an outer appearance matching that of the port.

7. The electrical connector assembly as claimed in claim 6, wherein the first connector comprises a printed circuit board connecting with the first contacts, a cable connecting with the printed circuit board electrically, and a cover assembled to a rear end of the first metal shell and a front end of the cable.

8. The electrical connector assembly as claimed in claim 1, wherein the second connector comprises a metal shell assembled to the second magnetic element.

9. An electrical connector assembly comprising:

a first connector and a second connector adapted to be mated with each other in a mating direction;

a plurality of first contacts disposed in the first connector;

a plurality of second contacts disposed in the second housing and adapted to be mated with the first contacts, respectively;

a first magnetic element located upon the first connector with a first coupling face; and a second magnetic element located upon the second connector with a second coupling face adapted to be opposite to said first coupling face in said mating direction; wherein the first coupling face defines a first N pole area and a first S pole area, and the second coupling face defines a second N pole area and a second S pole area corresponding to said first N pole area and said first S pole area to assure only one orientation is allowed for coupling the first connector and the second connector together due to magnetic characters; wherein disregarding the magnetic characters, a contour of the first connector and a contour of the second connector allows two orientations for coupling the first connector and the second connector together; wherein said first coupling face defines a long side direction and a short side direction perpendicular to each other and both perpendicular to said mating direction, and said first N pole area and said first S pole area are opposite to each other in said long side direction; said second coupling face is similar to said first coupling face with the second N pole area and the second S pole area opposite to each other in said long side direction.

10. The electrical connector assembly as claimed in claim 9, wherein the first magnetic element surrounds the first contacts, and the second magnetic element surrounds the second contacts.

11. The electrical connector assembly as claimed in claim 10, wherein the first contacts are retractable in the mating direction while the second contacts are immoveable.

12. A connector assembly comprising:

a first connector and a second connector adapted to be mated with each other in a mating direction;

the first connector defining a first mating port with a first magnetic element around the first mating port with a first coupling face thereon;

the second connector defining a second mating port with a second magnetic element around the second mating port with thereon a second coupling face adapted to be opposite to the first coupling face in the mating direction; wherein the first coupling face defines a first S pole area and a first N pole area, and the second coupling face defines a second S pole area and a second N pole area for assuring only one orientation between the first connector and the second connector during mating due to magnetic characters; wherein the first mating port defines a long side direction and a short side direction, and said first S pole area and said first N pole area are arranged opposite to each other along said long side direction; wherein disregarding the magnetic characters, the first mating port and the second mating port are configured to be mated with each other in two opposite orientations.

* * * * *